US006460194B1

(12) United States Patent
Ranzer

(10) Patent No.: US 6,460,194 B1
(45) Date of Patent: Oct. 8, 2002

(54) ADJUSTABLE DISPOSABLE CAP

(75) Inventor: Norman W. Ranzer, Jamison, PA (US)

(73) Assignee: Keystone Adjustable Cap Co., Pennsauken, NJ (US)

( * ) Notice: Subject to any disclaimer, the term of this patent is extended or adjusted under 35 U.S.C. 154(b) by 0 days.

(21) Appl. No.: 09/854,837

(22) Filed: May 14, 2001

(51) Int. Cl.[7] ..... A42B 1/00
(52) U.S. Cl. ..... 2/200.3
(58) Field of Search ..... 2/200.3, 901, 200.1, 2/209.11

(56) References Cited

U.S. PATENT DOCUMENTS

| | | | | |
|---|---|---|---|---|
| 2,669,725 A | | 2/1954 | Haegele | |
| 2,685,090 A | | 8/1954 | Wagenfeld | |
| 2,990,552 A | | 7/1961 | De Villers | |
| 3,383,709 A | * | 5/1968 | Bauer | 2/197 |
| 3,390,405 A | | 7/1968 | Gruber | |
| 3,523,303 A | | 8/1970 | Wagenfeld | |
| 4,055,857 A | | 11/1977 | Brucciani | |
| 4,186,446 A | | 2/1980 | Maney | |
| 4,213,206 A | | 7/1980 | Maney | |
| 4,244,058 A | | 1/1981 | Randall | |
| 4,282,607 A | | 8/1981 | Randall | |
| 4,286,338 A | | 9/1981 | Maney | |
| 4,651,352 A | * | 3/1987 | Ranzer | 2/197 |

FOREIGN PATENT DOCUMENTS

GB 1129863 10/1968

* cited by examiner

*Primary Examiner*—Peter Nerbun
*Assistant Examiner*—Katherine Moran
(74) *Attorney, Agent, or Firm*—Akin, Gump, Strauss, Hauer & Feld, L.L.P.

(57) ABSTRACT

An adjustable disposable cap which includes a headband and an accordion pleated crown. The headband is folded to form an outer panel and upper and lower longitudinally extending inner panels. The headband is further folded to form a central section and two end sections with the first of said end sections of said headband being slideably insertable into the other section of said headband so that the first end is moveable with respect to the other end. An accordion pleated crown is folded to form four panels in the crosssectional configuration of a "M" or "W". The lateral two panels of the crown are adhesively attached to the lower or upper inner panel of the headband at the central section and at the second of the two end sections of the headband. The first of the two end sections remains substantially free of the crown so that the head size of the cap is adjustable. The apex of the juncture of the middle panels of the crown is positioned above or below the location of the adhesive for attaching the two lateral panels of the crown to the headband. The width of the upper and lower panels of the crown is such that the free edges thereof are substantially spaced apart to define a wide gap therebetween. The width of the two lateral panels of the "M" shaped crown is such that the crown covers the gap between the upper and lower inner panels of the headband even when the hat is positioned on a wearer's head. Another embodiment includes a "W" shaped crown with two additional inner panels.

12 Claims, 5 Drawing Sheets

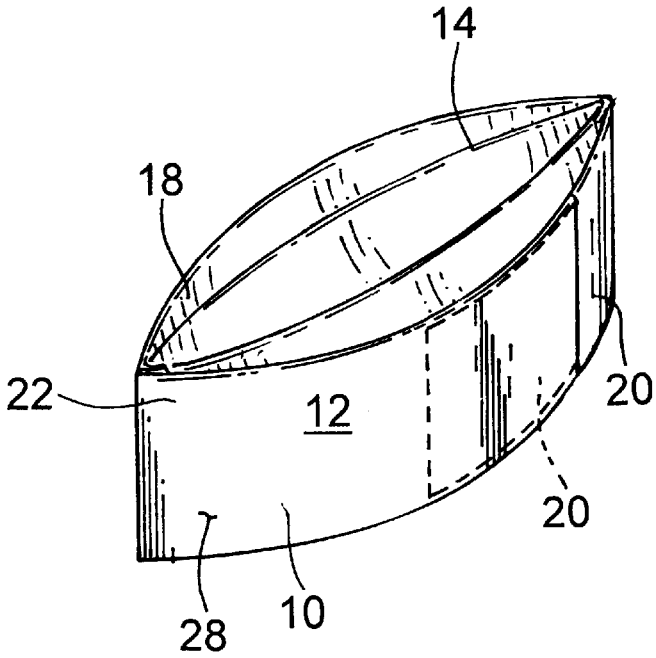
Fig. 1
Fig. 2
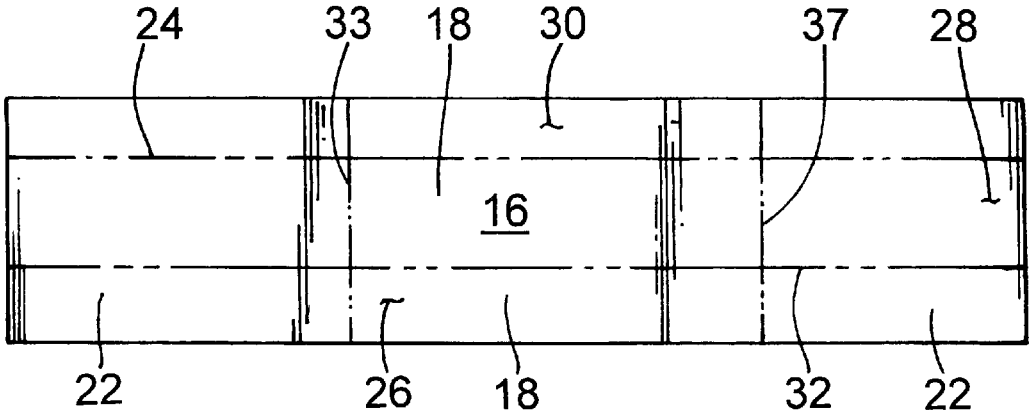
Fig. 3
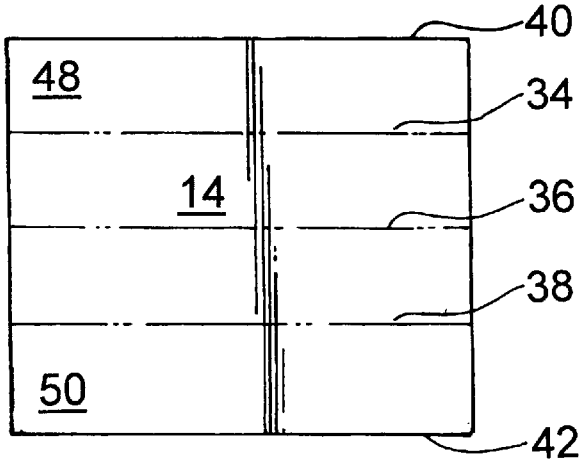

ADJUSTABLE DISPOSABLE CAP

BACKGROUND OF THE INVENTION

The present invention relates to disposable caps having an adjustable headband and an accordion folded crown. More particularly, the present invention relates to improvements in the structure of such caps making them more comfortable to wear; making the caps so they do not pop open at the crown; reducing their thickness for less costly packaging; making it easier to control the materials from which the caps are made during the manufacturing process; making facing, opposed crown panels less prone to being inadvertently joined during manufacture due to adhesive leaking through the crown material; and requiring less material to manufacture while retaining an appearance similar to that of caps that use more material for their manufacture.

Disposable paper caps are widely used for a number of purposes where it is necessary to prevent hair and other particles shed by food handlers from getting into work product, i.e. where it is necessary to maintain sanitary conditions such as during the preparation of food. Disposable caps suitable for this purpose typically include an adjustable headband and an accordion folded crown adhesively attached to the headband. Despite being in long and widespread use such caps still suffer from certain defects. One such defect is caps made with narrow multiple accordion pleats where the accordion fold is placed midway to high on the headband side panel. See for example U.S. Pat. No. 4,651,352 where the accordion folded crown 18 is positioned relatively high on the headband 20. This type of manufacture has a tendency to allow the free end of the crown paper material to pop open when the cap is pulled downward on the head especially when the cap is worn backwards. This exposes the wearer's head thus in part defeating the purpose of the cap.

Another issue is the thickness of the cap due to the use of eight or more overlying accordion folded panels in the crown. It therefore is desirable to reduce the number of accordion panels used to make the crown. For example, reducing the number of panels from eight to six or four makes the folded crown paper approximately 25% to 50% thinner in its folded condition. This means the cap itself is thinner in its folded condition. A cap having reduced thickness occupies less volume when packaged and is therefore less costly to ship. However, the overall dimensions and therefore the area of the crown must not be reduced as it must remain sufficiently expandable to cover a wearer's head.

Still another problem is the rising cost of paper which is the most common material used for the manufacture of disposable caps. It therefore is desirable to reduce the amount of paper used to manufacture the headband. This may be accomplished by reducing the width of the upper and lower inner panels of the headband. However, such reduction in width leaves a substantial gap between the free marginal edges of the upper and lower inner panels. This gap is perceptible when the cap is on the wearer's head and is considered to be a commercial defect. The problem of the perceptible gap between the inner panels is eliminated if the crown is attached to the lower inner panel of the headband. By this construction the crown obscures the gap.

Yet another problem is that during manufacture the glue used to adhesively attach the crown to the headband may leak through pin holes in the crown paper material. The leaking glue can cause unwanted attachment of opposed panels of the crown. It therefore is desirable to provide a cap structure that keeps the panels spaced apart until the glue or other adhesive dries.

During manufacture it can be difficult to control the tissue used to make the crown especially as it is folded into an accordion configuration. Control problems increase in proportion to the number of folds in the crown. It therefore follows that an accordion pleated crown with less panels and therefore less folds is easier to control.

These problems are resolved by the disposable cap construction described herein.

Paper caps having an adjustable headband and a tissue paper accordion pleated crown are known. See for example U.S. Pat. No. 4,651,352 issued to the present inventor and assigned to Keystone Adjustable Cap Co. The accordion pleated crown has eight panels and is adhesively attached to the upper panel 22. Keystone Adjustable Cap Co. has for a number of years manufactured and sold a paper cap corresponding to the cap shown in FIGS. 1, 2, 3, 4, and 5 of U.S. Pat. No. 4,651,352. The free marginal edges of the upper and lower inner panels of the headband for this cap are spaced about one-quarter inch apart.

Cellucap/Melco of Philadelphia, Pennsylvania has for many years made and sold a disposable paper cap having an adjustable headband and an accordion folded tissue paper pleated crown. The crown has eight panels with the outer most lateral panels being adhesively joined to the lower inner panel of the headband. The free edges of the upper and lower inner headband panels are spaced about seven-eighths inch apart.

U.S. Pat. No. 4,055,857 describes a disposable cap having an adjustable headband and an accordion folded crown. The upper and lower inner panels of the headband overlap to form a tubular headband structure. The crown has four panels formed into a "M" cross section configuration. The two lateral panels are adhesively attached to the upper inner panel of the headband.

U.S. Pat. No. 3,383,709 describes a cap with an adjustable headband and a pleated accordion crown. In one embodiment described in the patent the crown has only one fold to form two panels (FIGS. 3, 4, and 5). In another embodiment the crown has six panels (FIGS. 9 and 11). In both embodiments the crown is adhesively attached to the lower inner panel of the headband. The adjustable headband is either tubular or the free edges of the upper and lower inner panels are spaced apart. The crown is partly adhesively adhered to the upper inner panel of the headband, to the lower inner panel and to the outer panel at the space between the free ends of the upper and lower inner panels.

It therefore is an object of the present invention to provide a disposable adjustable cap having an adjustable headband and accordion folded crown. The cap has reduced thickness in its folded condition. The amount of paper or other material used to make the headband is reduced by reducing the width of the upper and lower inner panels of the headband leaving a substantial gap between the panels. The thickness of the crown is reduced by using a folded accordion crown having only four panels, or six in one embodiment. The lateral panels of the crown are adhesively joined to the lower inner panel of the headband. Accordingly, the crown generally covers the gap between the free edges of the upper and lower inner panels. This structure uses the same amount of material for the crown while providing a cap that is at least as comfortable as the prior art caps described above and at the same time eliminating the problem of exposure of the head when the cap is worn backwards.

The cross sectional structure of the crown reduces if not eliminates the problem of crown panels being adhesively joined due to leaking adhesive by positioning the apex of the two central panels above or below the location of the adhesive thus using the two central panels to space apart the opposed lateral panels.

By this construction the crown paper front side is held securely and glued on both sides making it impossible for the crown to pop up or outward from the headband.

BRIEF SUMMARY OF THE INVENTION

An adjustable disposable cap in accordance with the present invention includes an adjustable headband and an accordion folded crown. The headband is folded to form an outer panel and upper and lower longitudinally extending inner panels. The headband is further folded to form a central section and two end sections with the first of said end sections of said headband being slideably insertable into the other section of said headband so that the first end is moveable with respect to the other end. An accordion folded crown is folded to form four panels (or six in one embodiment of the invention) while maintaining the required width when the crown is expanded to accommodate larger head sizes. The lateral two panels of the crown are adhesively attached to the lower inner panel of the headband at the central section and to the second of the two end sections of the headband. In another embodiment of the invention the lateral panels are attached to the upper inner panel. The first of the two end sections remains substantially free of the crown so that the head size of the cap is adjustable. The apex of the juncture of the middle panels of the crown is positioned below or above the location of the adhesive for attaching the two lateral panels of the headband thus spacing those two panels apart to prevent inadvertent adhesive joining. The width of the upper and lower panels of the crown is such that the free edges thereof are substantially spaced apart to define a wide gap therebetween. The width of the two lateral panels of the crown in one embodiment is such that the crown covers the gap between the upper and lower inner panels of the headband even when the hat is positioned on a wearer's head.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 1 is a perspective view of an adjustable cap embodying the present invention;

FIG. 2 is an elevational view of the longitudinal sheet of flexible material which, when folded, will form the headband of the adjustable cap;

FIG. 3 is an elevational view of the elongated sheet which, when folded, will form the pleated crown of the adjustable cap;

DETAILED DESCRIPTION OF THE INVENTION

Figure 4:
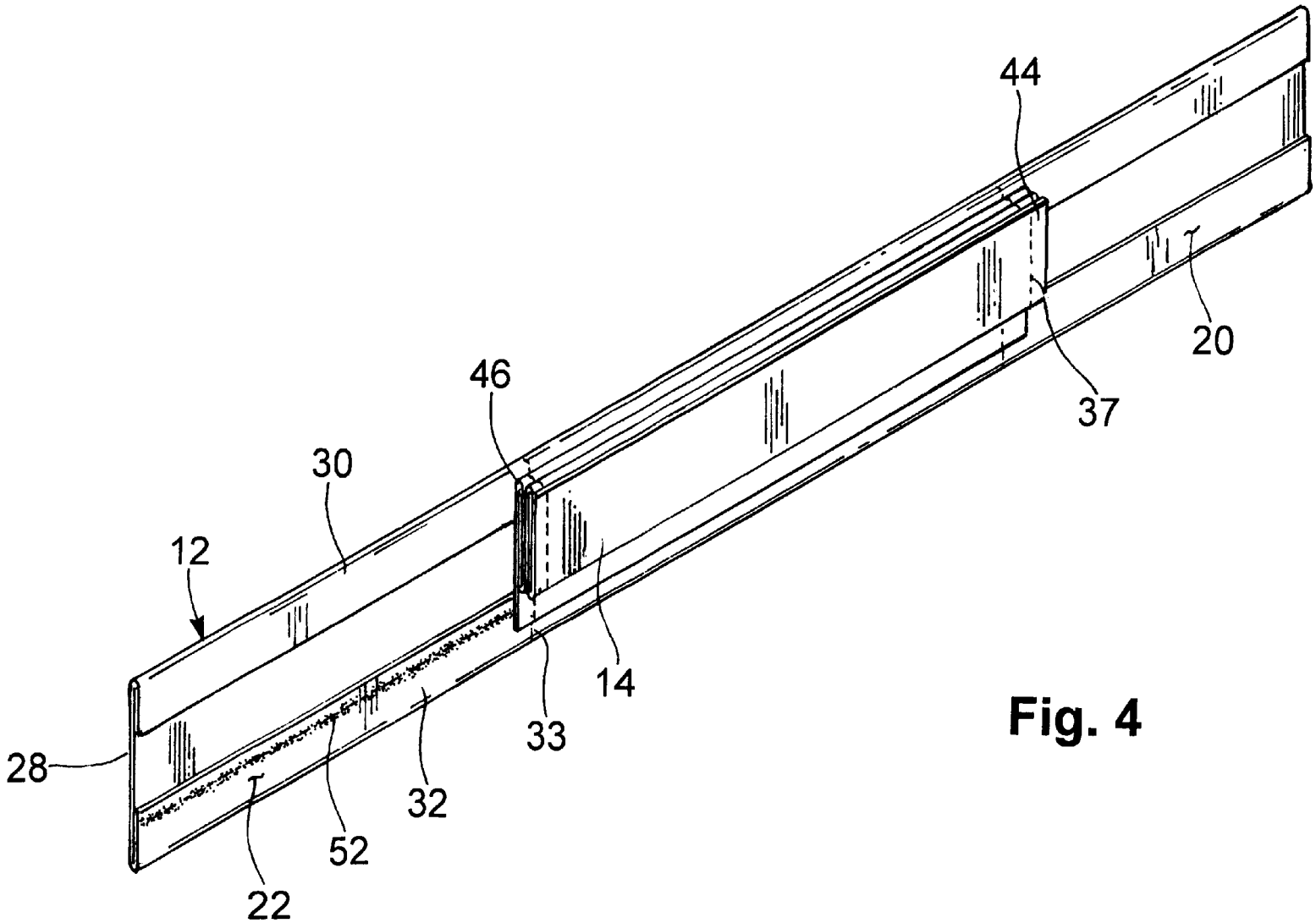
FIG. 4 is a perspective view of a partly folded headband with the pleated, collapsed crown secured to the central section of the headband.

Certain terminology may be used in the following description for convenience only and is not limiting. The words "left, " "right," "upper," and "lower" designate directions in the drawings to which reference is made. The words "inwardly" and "outwardly" refer to directions toward and away from, respectively, the geometric center of the walker and designated parts thereof. The terminology includes the words above specifically mentioned, derivatives thereof, and words of similar import.

Referring now to the drawings in detail, wherein like numerals indicate like structural elements, there is shown in FIG. 1 a perspective view of an adjustable cap in accordance with the present invention indicated generally as 10. The cap 10 is preferably made of flexible paper although it can be made of other flexible materials including woven and non-woven fabrics capable of being folded and assembled into the structures described herein. The assembled cap 10 includes an adjustable headband 12 and an accordion folded crown 14. The headband 12 is constructed from a sheet of flexible material 16 folded to form three sections; namely a central section 18, a first end section 20 and a second end section 22. As explained in more detail, the pleated crown 14 is adhesively attached to the headband 12 and extends across and over the length of the headband 12 to cover a wearer's head.

Headband 12 is formed of a rectangular horizontally extending sheet of material 16, such as paper of sufficient thickness so as to be self-supporting either by itself or when folded into the headband configuration described herein. The headband is preferably made from paper stock. Sheet 16 is folded along a pair of substantially parallel longitudinally extending fold lines 24 and 26. The result of folding along fold lines 24 and 26 is the formation of an outer panel 28, an upper inner panel 30, and a lower inner panel 32. The headband is then folded along a pair of parallel, transversely extending fold lines 33 and 37. This folding results in the central section 18, the first end section 20 and the second end section 22. All fold lines are show in phantom. Lower inner panel 32 may be somewhat wider than upper inner panel 30 to better accommodate printed instructions and labeling as desired. The width of the upper and lower inner panels should, however, be reduced as much as possible while still maintaining the structural integrity of the headband 12. This provides a savings in the amount of paper used to make the headband. For example, the upper inner panel may be approximately ⅞ of an inch wide and the lower inner panel approximately 1¼ inches wide.

Figure 5:
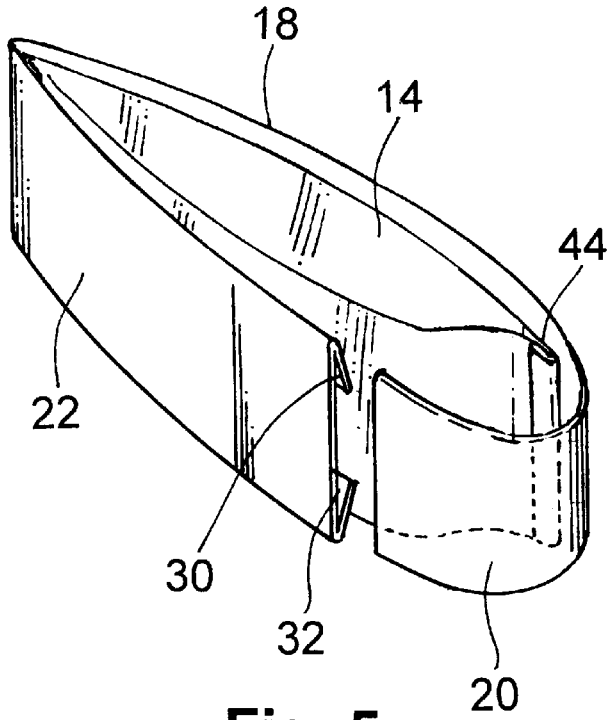
FIG. 5 is a perspective view of the adjustable cap showing how one end section of the headband is telescopically joined to the other end section to provide an adjustable headband.

As show in FIG. 5, to form the assembled cap, the end section 20 is telescopically inserted into end section 22. The end section 22 is substantially not attached to the pleated crown. Thus it is freely movable with respect to the end section 22 so that the headband 12 may be adjusted in size to accommodate different wearer head sizes.

The crown 14 is formed of an elongated rectangular sheet of paper which is folded along three substantially parallel, longitudinally extending fold lines 34, 36 and 38. The fold lines 34, 36, and 38 are equally spaced apart from each other but fold lines 34 and 38 are preferably, but not necessarily, at a greater distance from the longitudinal marginal edges 40 and 42 of crown than they are from central fold line 36. All fold lines for the crown are shown in phantom.

Figure 6:
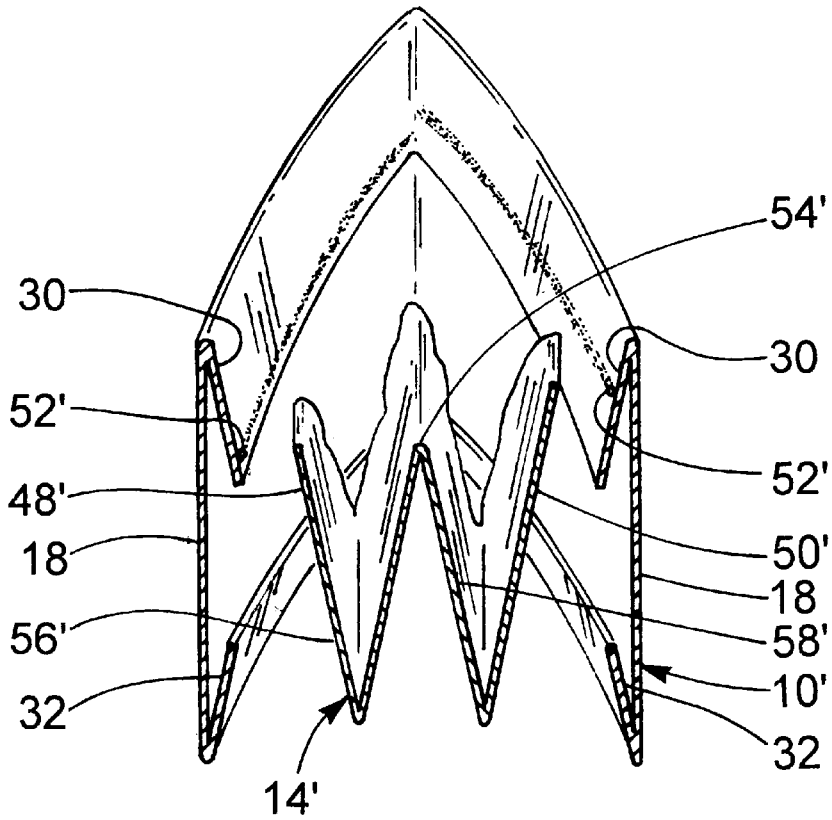
FIG. 6 is a vertical sectional of another embodiment of the invention similar to the section in FIG. 7.
Figure 7:
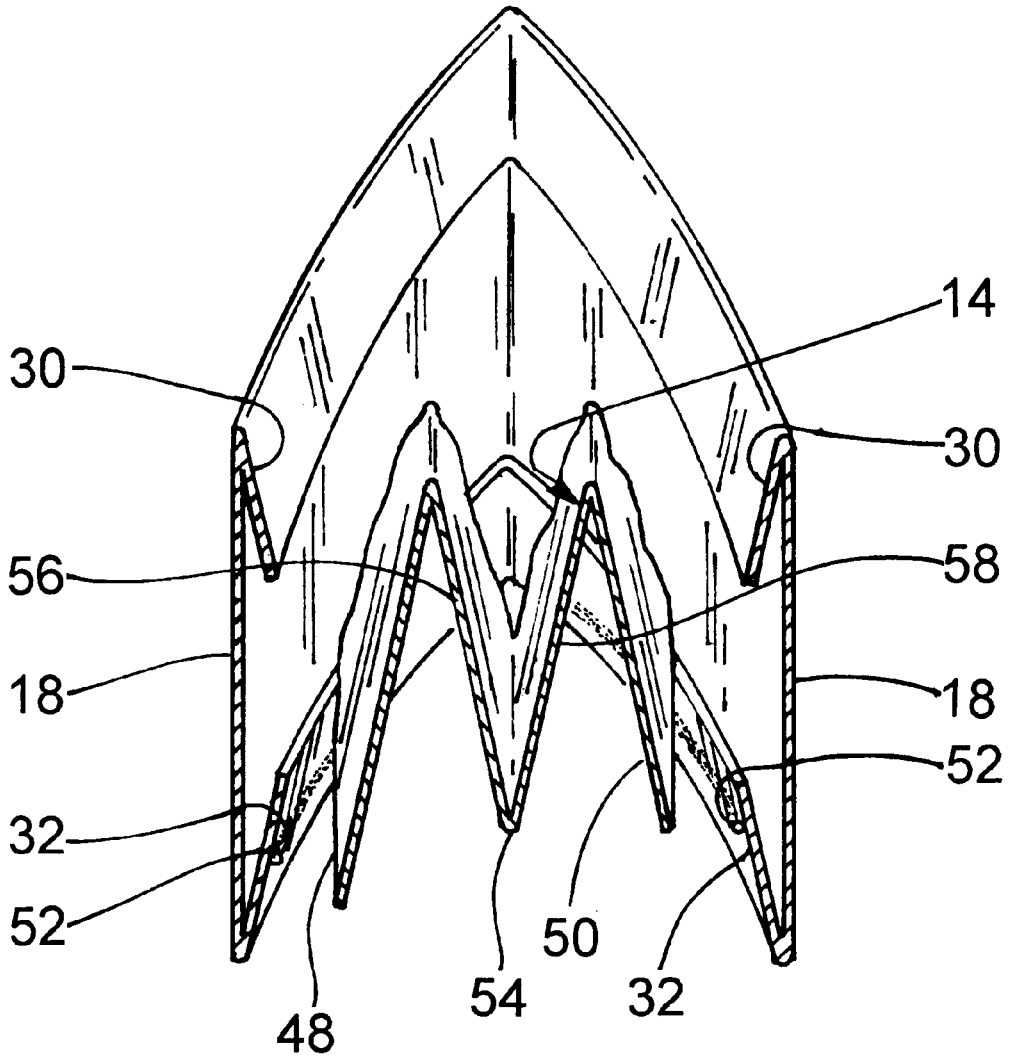
FIG. 7 is a vertical sectional view of the adjustable cap taken along the line 6—6 in FIG. 1.

The crown is folded along fold lines 34, 36 and 38 to form an accordion structure which in cross section has the general configuration of a "W" as shown in FIG. 6 or a "M" as shown in FIG. 7. The crown is made from a sheet of material that is relatively thinner than the material from which the headband is constructed. The crown is preferably made from tissue paper.

The transverse width of the crown 14 is sufficient to cover the ear to ear width of the largest anticipated head dimension allowing for a thick head of hair. Typically a width of about 9¼ inches has been found to be about right for a commercially acceptable cap. The longitudinal dimension of the crown 14 is typically slightly greater than the longitudinal length of the central section 18 of the headband 12. Thus a short length 44 of pleated crown extends a short distance beyond the transverse fold line 37 (FIG. 4) which normally defines the rear of the adjustable cap 10. The crown 14 may also be of a length so that a small length 46 of the crown extends past the fold line 33. The portions 44 and 46 are folded over at the fold lines 37 and 33 when the cap is assembled as show in FIG. 5.

The crown 14 is attached to the headband 12 by adhesive, preferably a line of adhesive applied to the central section 18 and end section 22 of the lower inner panel. As shown in FIGS. 4 and 6, the adhesive is applied so as to attach the lateral panels 48 and 50 to the lower inner panel 32 of the headband. Preferably the adhesive is a narrow longitudinal strip 52 applied to the central section 18 and to the end section 22 of the lower inner panel 32 as shown in FIG. 4. Lateral panel 48 of the rear portion 44 may be, but does not have to be, attached to the lower panel 32 of the first end section 20. However the first end section 20 needs to remain substantially free and not attached to the crown so it can be inserted into the second end section and remain moveable for adjustment of the headband. When the cap is fully assembled, the second end section 22 is folded along the fold line 33 and is adhesively attached to the lateral panel 50 of the crown 12 by the adhesive strip 52.

As shown in FIG. 7, the apex 54 where the two middle panels 56 and 58 of the crown are formed by fold line 36 is positioned above the adhesive strip 52. This is the result of making the distances between fold lines 34, 36 and 38, respectively, less than the distance between fold line 34 and marginal edge 40 and fold line 38 and marginal edge 42. Because tissue paper or other relatively thin material is used for the crown, the adhesive 52 sometimes leaks through the holes in the material. This can result in one or both lateral panels 48 or 50 becoming attached to each other or to a middle panel if the adhesive is placed too high. When this happens, the cap must be discarded. To prevent this unwanted condition the apex 54 is located above the line of adhesive 52. Consequently the middle panels 56 and 58 form a spacer holding the panels 48 and 50 apart at least until the adhesive dries. Of course in the present embodiment of the invention leaking adhesive cannot attach to the middle panels because of their physical location above the adhesive line 52.

The use of an accordion folded crown having only four panels in the illustrated configuration has the advantage of providing an adjustable cap that is overall thinner than caps that have six, eight or more folded panels. Compare the crown 18 in U.S. Pat. No. 4,651,352. This means that more caps can be stacked in a container thus reducing the cost of packaging as well as shipping which depends primarily on the volume of the shipped goods. Also less space is required for storage. The use of a four fold crown is about as comfortable as those adjustable caps that use more folds. Moreover, it has the same approximately 9¼ inch width.

Attaching the outer two panels of the crown to the lower inner panel resolves the problem crown pop-out associated with wearing the cap backwards or pulling the cap tightly down over the skull. As noted above, wearing a prior adjustable cap backwards or too tightly would at times cause the unattached rear portion of the crown to project above the headband thereby exposing the wearer's head. This of course defeats the protective purpose of the cap. Attaching the crown to the lower inner panel prevents crown "pop-out" even when the cap is worn backwards or too tightly.

An advantage of attaching the crown to the lower inner panel of the headband is that it permits a reduction in the amount of paper needed to form the headband. Headbands are typically made in tubular form or with the free marginal edges fairly close together. This makes the headband generally two layers thick and therefore relatively opaque. The overall width of the headband is reduced in accordance with the present invention by reducing the width of the upper and lower inner panels 30 and 32 as explained above. This presents a commercial problem in that the exposed band of material between the free marginal edges of the upper and lower inner panels is relatively translucent and therefore visible. This is considered to be commercially undesirable. However, the problem of perceptible translucence is greatly reduced because the outer two panels of the crown are attached to the lower inner panel and extend upward over the exposed intermediate part of the band. The translucent part of the band is therefore not as readily perceived. At the same time the cost of making the headband is lowered by reducing the amount of paper used to manufacture it. In the preferred embodiment, the height of the headband remains approximately 3⅜ inches which is conventional. The width of the upper inner panel 30 is approximately ¾ inches. The width of the lower inner panel 32 is approximately 1⅜ inches. This leaves an exposed gap in the outer panel 28 of approximately 1¼ inches which is substantial compared to the gap in prior commercial paper caps. As shown in FIGS. 5 and 7, the crown 14 fully overlies this gap.

Ease of manufacture is another advantage attributable to a cap with a crown pleated with only four folded panels. Tissue paper, which is preferably used for the crown, is harder to handle than thicker paper stock primarily because tissue is not self supporting. It is significantly easier to crease and fold crown tissue paper with less fold lines as compared to imparting seven fold lines to create eight pleated panels as in the adjustable cap disclosed in U.S. Pat. No. 4,651,352.

FIG. 6 illustrates another embodiment of the present invention where the four panel accordion folded crown 14' is adhesively attached to the upper inner panel 30 rather than the lower inner panel 32 as illustrated in FIG. 7. As shown, the crown 14' includes four panels including outer panels 48', 50' and inner panels 56', 58'. Inner panels 56' and 58' are joined to each other at the apex 54'. As shown, the outer panels 48' and 50' are adhesively joined to the upper inner panels along the line of adhesive 52'. The apex 54' is below the line of adhesive. Thus the spacing effect of panels 56' and 58' remains present to prevent glue 52' that leaks through pinholes in the crown tissue paper from causing adjacent panels to adhere to each other. The cap 10' shown in FIG. 6 is essentially an inverted version of the cap 10 shown in the remaining figures. The difference is that when the cap 10' when placed on a wearer's head the outer panels of the crown will no longer cover the space between the free marginal edges of the upper inner panel 30 and the lower inner panel 32.

The advantage of the configuration shown in FIG. 6 is that the cap 10 provides somewhat more headroom since the crown 14' is the same except with respect to the positioning of the glue lines. Reversing the cap as shown in FIG. 7 results in a more snug fit for a smaller head and also provides the desirable concealment of the gap between the upper and lower inner panels. Yet another advantage of the cap shown in both FIGS. 6 and 7 is that a crown with only four folds conforms to the shape of the head better than those which use six or eight folds of narrower width.

Figure 8:
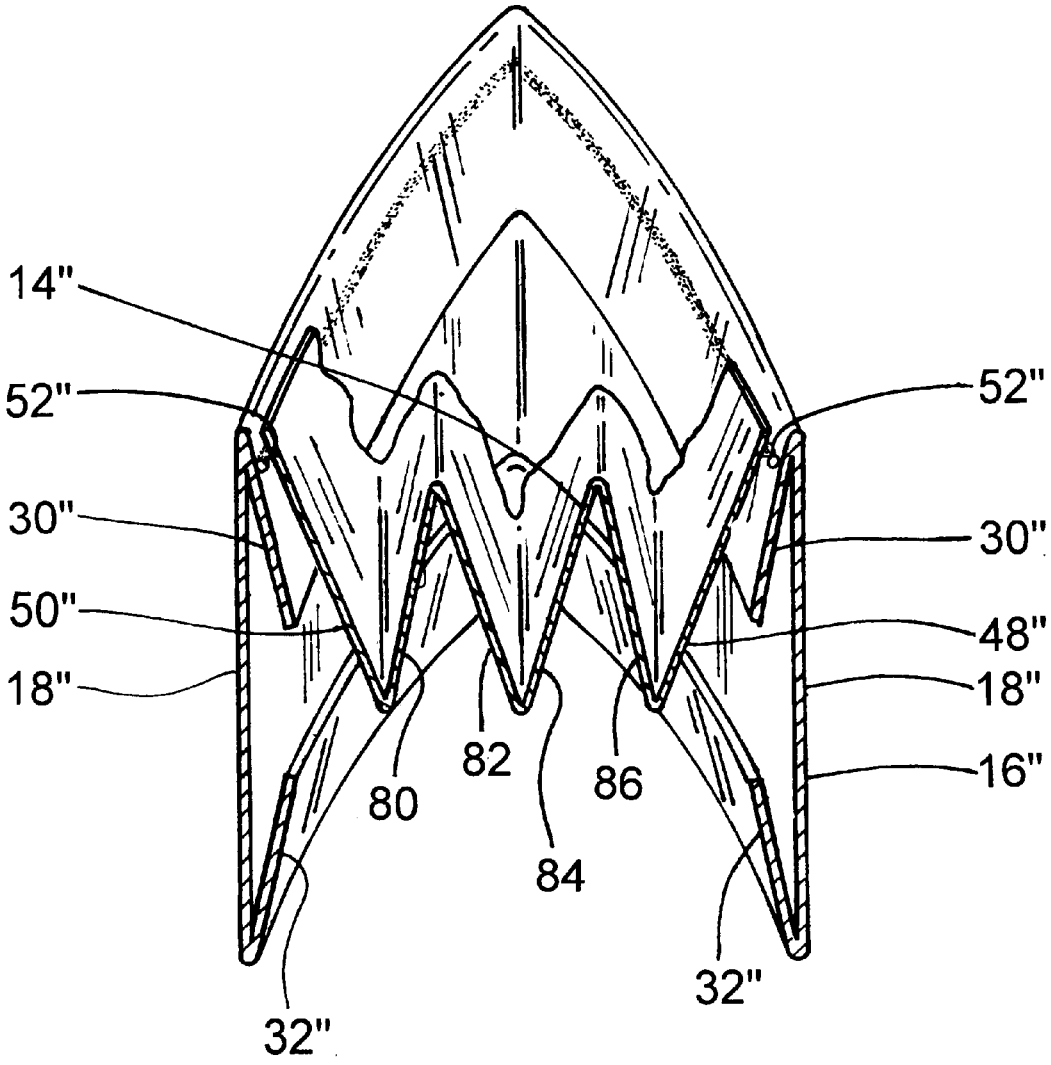
FIG. 8 is a vertical sectional view of another embodiment of the adjustable cap.

The advantage of the configuration shown in FIG. 8 is that the cap 10 provides somewhat more headroom since the crown 14" is attached to the upper inner panel 30".

FIG. 8 illustrates another embodiment of the present invention. In the embodiment illustrated in FIG. 8, the accordion folded crown 14" is adhesively attached to the upper inner panel 30" by the line of glue 52". As shown, the crown 14" is folded to provide six panels including the outer panels 48" and 50". In this embodiment, the inner panels are folded into four panels 80, 82, 84 and 86. Thus the crown 14" has a total of six panels. The overall width of the crown 14", however, is the same as the embodiments described above, for example 9¼ inches. In principle, the crown 14" of FIG. 8 is the same as the "W" shaped crown 14" of FIG. 6 except the additional two panels 82 and 84 provide for somewhat better vertical expansion, particularly at the front and back of the cap. The apices 88 and 90 of the inner panels are below the line of adhesive 52". Stated differently, the outer panels 48" and 50" are wider than the inner panels 80, 82, 84 and 86. Thus the spacing effect of the inner panels remains present to prevent glue 52" that leaks through pinholes in the crown tissue paper from causing adjacent panels to adhere to each other. The use of six panels as opposed to eight panels reduces the amount of paper required for the crown and the overall thickness of a folded cap.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An adjustable disposable cap made of a flexible material or materials such as paper or the like, said cap comprising:

a. a headband; and b. an accordion folded crown adhesively attached to the headband;

c. said headband comprising a longitudinal sheet of flexible material having a pair of longitudinally extending fold lines, said sheet being folded about said fold lines to form an outer panel and upper and lower inner panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion folded crown comprising an elongated sheet folded to form four panels in the cross sectional configuration of a "M", the lateral two panels of the crown being adhesively attached to the lower inner panel of the headband at the central section and at the second of the two end sections of the headband, the first of the two end sections of the headband being substantially free of the crown so that the head size of said cap is adjustable;

e. the apex of the juncture of the two middle panels of the crown being above the location of the adhesive for attaching the two lateral panels of the crown to the headband;

f. the width of the upper and lower inner panels of the headband being such that the free edges thereof are substantially spaced apart to define a wide gap therebetween;

g. the width of the two lateral panels of the crown being such that the crown covers the gap between the upper and lower inner panels of the headband even when the hat is positioned on a wearer's head.

2. An adjustable disposable cap in accordance with claim 1 wherein the headband is made of self-supporting paper and the crown is made of tissue paper.

3. An adjustable disposable cap in accordance with claim 1 wherein the combined width of the four panels of the crown is wide enough to cover a wearer's head of all conventional sizes.

4. An adjustable disposable cap made of a flexible material or materials such as paper or the like, said cap comprising:

a. a headband; and b. an accordion folded crown adhesively attached to the headband;

c. said headband comprising a longitudinal sheet of flexible material having a pair of longitudinally extending fold lines, said sheet being folded about said fold lines to form an outer panel and upper and lower inner panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion folded crown comprising an elongated sheet folded to form four panels in the cross sectional configuration of a "M", the lateral two panels of the crown being adhesively attached to the lower inner panel of the headband at the central section and to the second of the two end sections of the headband, the first of the two end sections of the headband being substantially free of the crown so that the head size of said cap is adjustable;

e. the width of the upper and lower inner panels of the headband being such that the free edges thereof are substantially spaced apart to define a wide gap therebetween;

f. the width of the two lateral panels of the crown being such that the crown covers the gap between the upper and lower inner panels of the headband even when the hat is positioned on a wearer's head.

5. An adjustable disposable cap in accordance with claim 4 wherein the headband is made of self-supporting paper and the crown is made of tissue paper.

6. An adjustable disposable cap in accordance with claim 4 wherein the combined width of the four panels of the crown in combination is wide enough to cover a wearer's head of all conventional sizes.

7. An adjustable disposable cap made of a flexible material or materials such as paper or the like, said cap comprising:

a. a headband; and b. an accordion pleated crown adhesively attached to the headband;

c. said headband comprising a longitudinal sheet of flexible material having a pair of longitudinally extending fold lines, said sheet being folded about said fold lines to form an outer panel and upper and lower panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion pleated crown comprising an elongated sheet folded to form four panels in the cross sectional configuration of a "M", the lateral two panels of the crown being adhesively attached to the lower inner panel of the headband at the central section and to the second of the two end sections of the headband, the first of the two end sections of the headband being substantially free of the crown so that the head size of said cap is adjustable;

e. the apex of the juncture of the two middle panels of the crown being above the location of the adhesive for attaching the two lateral panels of the crown to the headband.

8. An adjustable disposable cap in accordance with claim 7 wherein the headband is made of self-supporting paper and the crown is made of tissue paper.

9. An adjustable disposable cap in accordance with claim 7 wherein the combined width of the four panels of the crown in combination is wide enough to cover a wearer's head of all conventional sizes.

10. An adjustable disposable cap made of a flexible material or materials such as paper or the like, said cap comprising:

a. a headband; and b. an accordion folded crown adhesively attached to the headband;

c. said headband comprising a longitudinal sheet of flexible material having a pair of longitudinally extending fold lines, said sheet being folded about said fold lines to form an outer panel and upper and lower inner panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion folded crown comprising an elongated sheet folded to form four panels, the lateral two panels of the crown being adhesively attached to the upper inner panel of the headband at the central section and to the second of the two end sections of the headband, the first of the two end sections of the headband being substantially free of the crown so that the head size of said cap is adjustable;

e. the apex of the juncture of the two middle panels of the crown being below the location of the adhesive for attaching the two lateral panels of the crown to the headband;

f. the width of the upper and lower inner panels of the headband being such that the free marginal edges thereof are substantially spaced apart to define a wide gap therebetween.

11. An adjustable disposable cap made of a flexible material or materials such as paper or the like, said cap comprising:

a. a headband; and b. an accordion folded crown adhesively attached to the headbhand;

c. said headband comprising a longitudinal sheet of flexible material having a pair of longitudinally extending fold lines, said sheet being folded about said fold lines to form an outer panel and upper and lower inner panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion folded crown comprising an elongated sheet folded to form six panels, the lateral two panels of the crown being adhesively attached to the upper inner panel of the headband at the central section and at the second of the two end sections of the headband, the first of the two end sections of the headband being substantially free of the crown so that the head size of the cap is adjustable;

e. the upper apices of the juncture of the middle panels of the crown being below the adhesive for attaching the two lateral panels of the crown to the headband.

12. An adjustable disposable cap made of a flexible material or materials such as paper or the like, said cap comprising:

a. a headband; and b. an accordion folded crown adhesively attached to the headbhand;

c. said headband comprising a longitudinal sheet of flexible material having a pair of longitudinally extending fold lines, said sheet being folded about said fold lines to form an outer panel and upper and lower inner panels, said headband further including a pair of substantially parallel, transversely extending fold lines, said headband being folded about said transversely extending fold lines to form a central section and two end sections with the first of said end sections of said headband being slideably insertable into the other end section of said headband so that said first end is moveable with respect to said other end;

d. said accordion folded crown comprising an elongated sheet folded to form six panels, the free edges of the lateral two panels of the crown extending upwardly in relation to the headband, said lateral two panels being adhesively attached to the upper inner panel of the headband at the central section and at the second of the two end sections of the headband, the first of the two end sections of the headband being substantially free of the crown so that the head size of the cap is adjustable.

* * * * *